US007131283B2

(12) United States Patent
Oh et al.

(10) Patent No.: US 7,131,283 B2
(45) Date of Patent: Nov. 7, 2006

(54) METHOD FOR CONTROLLING MULTI-TYPE AIR CONDITIONER

(75) Inventors: Il Kwon Oh, Seoul (KR); Min Sub Shim, Gunpo-si (KR); Jin Seob Song, Gunpo-si (KR); Se Dong Chang, Gwangmyeong-si (KR); Bong Soo Park, Dongjak-gu (KR); Do Yong Ha, Gwangmyeong-si (KR); Seung Yong Chang, Yangcheon-gu (KR)

(73) Assignee: LG Electronics Inc., Seoul (KR)

( * ) Notice: Subject to any disclaimer, the term of this patent is extended or adjusted under 35 U.S.C. 154(b) by 145 days.

(21) Appl. No.: 10/879,202

(22) Filed: Jun. 30, 2004

(65) Prior Publication Data

US 2005/0155368 A1 Jul. 21, 2005

(30) Foreign Application Priority Data

Jan. 19, 2004 (KR) ..... 10-2004-0003881

(51) Int. Cl.
*F25B 29/00* (2006.01)
*F25B 5/00* (2006.01)
*F25B 41/04* (2006.01)

(52) U.S. Cl. ..... 62/159; 62/200; 62/223; 62/224

(58) Field of Classification Search ..... 62/159, 62/160, 199, 200, 222, 223, 224
See application file for complete search history.

(56) References Cited

U.S. PATENT DOCUMENTS 5,600,962 A * 2/1997 Aizawa et al. ..... 62/204
5,910,159 A * 6/1999 Matsuo et al. ..... 62/158
2006/0026979 A1* 2/2006 Jung et al. ..... 62/199

FOREIGN PATENT DOCUMENTS

JP 60-134227 7/1985

(Continued)

OTHER PUBLICATIONS

English Language Abstract of JP 5-248722.

(Continued)

*Primary Examiner*—Marc Norman
(74) *Attorney, Agent, or Firm*—Greenblum & Bernstein, P.L.C.

(57) ABSTRACT

Method for controlling a multi-type air conditioner having a plurality of indoor units each with an expansion valve, an indoor heat exchanger, and an indoor fan, some of which heat rooms, and rest of which are turned off, including the steps of (S11) defining a saturation temperature of refrigerant by using a heating cycle of the refrigerant, and Mollier chart, (S12) measuring a temperature of the refrigerant stagnant at the turned off indoor units, (S13) determining if a temperature difference of the refrigerant temperature and the saturation temperature is within a temperature range preset at a control part, (S14) opening the expansion valves of the turned off indoor units, if the temperature difference is within the temperature range preset at the control part, and (S15) closing the expansion valve of the turned off indoor units, if the temperature difference is not within the temperature range preset at the control part, whereby minimizing stagnation of refrigerant at turned off indoor units during some of the indoor units are in operation for heating rooms, and reduce noise occurred when the stagnant refrigerant is removed.

29 Claims, 10 Drawing Sheets

FOREIGN PATENT DOCUMENTS

| | | | |
|---|---|---|---|
| JP | 62-043269 | | 2/1987 |
| JP | 62-049146 | | 3/1987 |
| JP | 62-288441 | | 12/1987 |
| JP | 04-198672 | | 7/1992 |
| JP | 5-248722 | | 9/1993 |
| JP | 9-236348 | | 9/1997 |
| JP | 11-173628 | | 7/1999 |
| JP | 11-325639 | | 11/1999 |
| JP | 11325639 | A * | 11/1999 |
| JP | 2003-254588 | | 9/2003 |

OTHER PUBLICATIONS

English Language Abstract of JP 2003-254588.
English Language Abstract of JP 11-325639.
English Language Abstract of JP 11-173628.
English Language Abstract of JP 9-236348.
English Language Abstract of JP 60-134227.
English Language Abstract of JP 62-288441.
English Language Abstract of JP 62-049146.
English language Abstract of JP 04-198672.

* cited by examiner

METHOD FOR CONTROLLING MULTI-TYPE AIR CONDITIONER

This application claims the benefit of the Korean Application No. P2004-3881 filed on Jan. 19, 2004, which is hereby incorporated by reference.

BACKGROUND OF THE INVENTION

1. Field of the Invention

The present invention relates to multi-type air conditioner, and more particularly, to a method for controlling a multi-type air conditioner which enables to minimize stagnation of refrigerant at turned off indoor units during some of the indoor units are in operation for heating rooms, and reduce noise occurred when the stagnant refrigerant is removed.

2. Background of the Related Art

In general, the air conditioner is an apparatus for cooling or heating rooms, such as residential space, restaurant, office, and the like. Nowadays, for effective cooling/heating of a room space divided into a plurality of rooms, there has been ceaseless development of the multi-type air conditioner that can perform cooling or heating, or cooling and heating at the same time depending on an operation condition.

The multi-type air conditioner has a plurality of indoor units connected to one outdoor unit, so that only some of the indoor units perform cooling or heating according to user's requirement.

In this instance, in a case some of the indoor units of the multi-type air conditioner perform heating, even though the indoor units which perform heating is turned on, rest of the indoor units are turned off.

However, since the refrigerant is supplied from the outdoor unit to all of the indoor units of the multi-type air conditioner, the refrigerant is introduced into the turned off indoor units unnecessarily and stagnant therein as the heating is progressed.

The stagnant refrigerant at the turned off indoor units results in shortage of refrigerant circulating through the multi-type air conditioner, not only to reduce operation efficiency, but also elevate a discharge temperature of the refrigerant and reduce a discharge pressure, owing to a low flow rate of refrigerant in/out of the compressor.

Therefore, a control part of the multi-type air conditioner opens an expansion valve on the turned off indoor unit, to prevent stagnation of the refrigerant.

However, the uniform opening of the expansion valves at regular intervals by the control part of the related art multi-type air conditioner makes performance of proper operation control difficult.

Particularly, because a loud noise is occurred when the expansion valve is opened to discharge the refrigerant, if the expansion valve is opened periodically regardless of operation condition, to occur the noise periodically, product reliability drops, and complaints from users will result in.

SUMMARY OF THE INVENTION

Accordingly, the present invention is directed to a method for controlling a multi-type air conditioner that substantially obviates one or more of the problems due to limitations and disadvantages of the related art.

An object of the present invention is to provide a method for controlling a multi-type air conditioner, which can minimize stagnant refrigerant at turned off indoor units during heating operation of some of the indoor units.

Other object of the present invention is to provide a method for controlling a multi-type air conditioner, which can reduce noise occurred when the stagnant refrigerant is removed from the turned off indoor units.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the method for controlling a multi-type air conditioner having a plurality of indoor units each with an expansion valve, an indoor heat exchanger, and an indoor fan, some of which heat rooms, and rest of which are turned off, includes the steps of (S11) defining a saturation temperature of refrigerant by using a heating cycle of the refrigerant, and Mollier chart, (S12) measuring a temperature of the refrigerant stagnant at the turned off indoor units, (S13) determining if a temperature difference of the refrigerant temperature and the saturation temperature is within a temperature range preset at a control part, (S14) opening the expansion valves of the turned off indoor units, if the temperature difference is within the temperature range preset at the control part, and (S15) closing the expansion valve of the turned off indoor units, if the temperature difference is not within the temperature range preset at the control part.

Preferably, the S14 step includes the step of opening the expansion valve at an extent of opening of $1\%<A<20\%$. Preferably, the method further includes the step of performing all the steps starting from the S11 step again after the S14 or S15 step is performed.

The refrigerant is pure refrigerant, and the saturation temperature is defined as a temperature T1 or T2 of a point where a condensing section of the heating cycle and Mollier chart meet.

The refrigerant is mixed refrigerant, and the saturation temperature is defined as an average temperature of the temperatures T1 and T2 of points where a condensing section of the heating cycle and Mollier chart meet.

The refrigerant is mixed refrigerant, and the saturation temperature is defined as a weighted average temperature of the temperatures T1 and T2 of points where a condensing section of the heating cycle and Mollier chart meet.

In the meantime, the refrigerant temperature is a temperature of the refrigerant introduced into/discharged from the indoor heat exchanger.

The refrigerant temperature is an average of a temperature of the refrigerant introduced into the indoor heat exchanger, and a temperature of the refrigerant discharged from the indoor heat exchanger.

In the meantime, preferably the temperature range preset at the control part varies with a room temperature, or an outdoor temperature. Preferably, the temperature range preset at the control part varies with a room temperature and an outdoor temperature.

In other aspect of the present invention, there is provided a method for controlling a multi-type air conditioner having a plurality of indoor units each with an expansion valve, an indoor heat exchanger, and an indoor fan, some of which heat rooms, and rest of which are turned off, including the steps of (S21) defining a room temperature, (S22) measuring a temperature of the refrigerant stagnant at the turned off indoor units, (S23) determining if a temperature difference of the refrigerant temperature and the saturation temperature is within a temperature range preset at a control part, (S24) opening the expansion valves of the turned off indoor units, if the temperature difference is within the temperature range preset at the control part, and (S25) closing the expansion valve of the turned off indoor units, if the temperature difference is not within the temperature range preset at the control part.

In another aspect of the present invention, there is provided a method for controlling a multi-type air conditioner having a plurality of indoor units each with an expansion valve, an indoor heat exchanger, and an indoor fan, some of which heat rooms, and rest of which are turned off, including the steps of (S31) opening the expansion valves of the turned off indoor units at a first extent 'B' of opening, (S32) defining a saturation temperature of refrigerant by using a heating cycle of the refrigerant, and Mollier chart, (S33) measuring a temperature of the refrigerant stagnant at the turned off indoor units, (S34) determining if a temperature difference of the refrigerant temperature and the saturation temperature is within a temperature range preset at a control part, (S35) opening the expansion valves of the turned off indoor units at a second extent 'C' of opening greater than the first extent of opening, if the temperature difference is within the temperature range preset at the control part, and (S36) opening the expansion valves of the turned off indoor units at the first extent of opening 'B', if the temperature difference is not within the temperature range preset at the control part.

Preferably, the first extent 'B' of opening of the expansion valve is 1%<B<10%, and the second extent 'C' of opening of the expansion valve is 4%<C<20%.

The method further includes the step of performing all the steps in succession again starting from the S32 step after the S35 or S36 step is performed.

In the meantime, the refrigerant is pure refrigerant, and the saturation temperature is defined as a temperature T1 or T2 of a point where a condensing section of the heating cycle and Mollier chart meet.

The refrigerant is mixed refrigerant, and the saturation temperature is defined as an average temperature of the temperatures T1 and T2 of points where a condensing section of the heating cycle and Mollier chart meet.

The refrigerant is mixed refrigerant, and the saturation temperature is defined as a weighted average temperature of the temperatures T1 and T2 of points where a condensing section of the heating cycle and Mollier chart meet.

The refrigerant temperature is a temperature of the refrigerant introduced into or discharged from the indoor heat exchanger.

The refrigerant temperature is an average of a temperature of the refrigerant introduced into the indoor heat exchanger, and a temperature of the refrigerant discharged from the indoor heat exchanger.

Preferably, the temperature range preset at the control part varies with a room temperature, or an outdoor temperature. The temperature range preset at the control part varies with a room temperature and an outdoor temperature.

In further aspect of the present invention, there is provided a method for controlling a multi-type air conditioner having a plurality of indoor units each with an expansion valve, an indoor heat exchanger, and an indoor fan, some of which heat rooms, and rest of which are turned off, including the steps of (S41) opening the expansion valves of the turned off indoor units at a first extent 'B' of opening, (S42) measuring a room temperature, (S43) measuring a temperature of the refrigerant stagnant at the turned off indoor units, (S44) determining if a temperature difference of the refrigerant temperature and the room temperature is within a temperature range preset at a control part, (S45) opening the expansion valves of the turned off indoor units at a second extent 'C' of opening greater than the first extent of opening, if the temperature difference is within the temperature range preset at the control part, and (S46) opening the expansion valves of the turned off indoor units at the first extent of opening 'B', if the temperature difference is not within the temperature range preset at the control part.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

Figure 9:
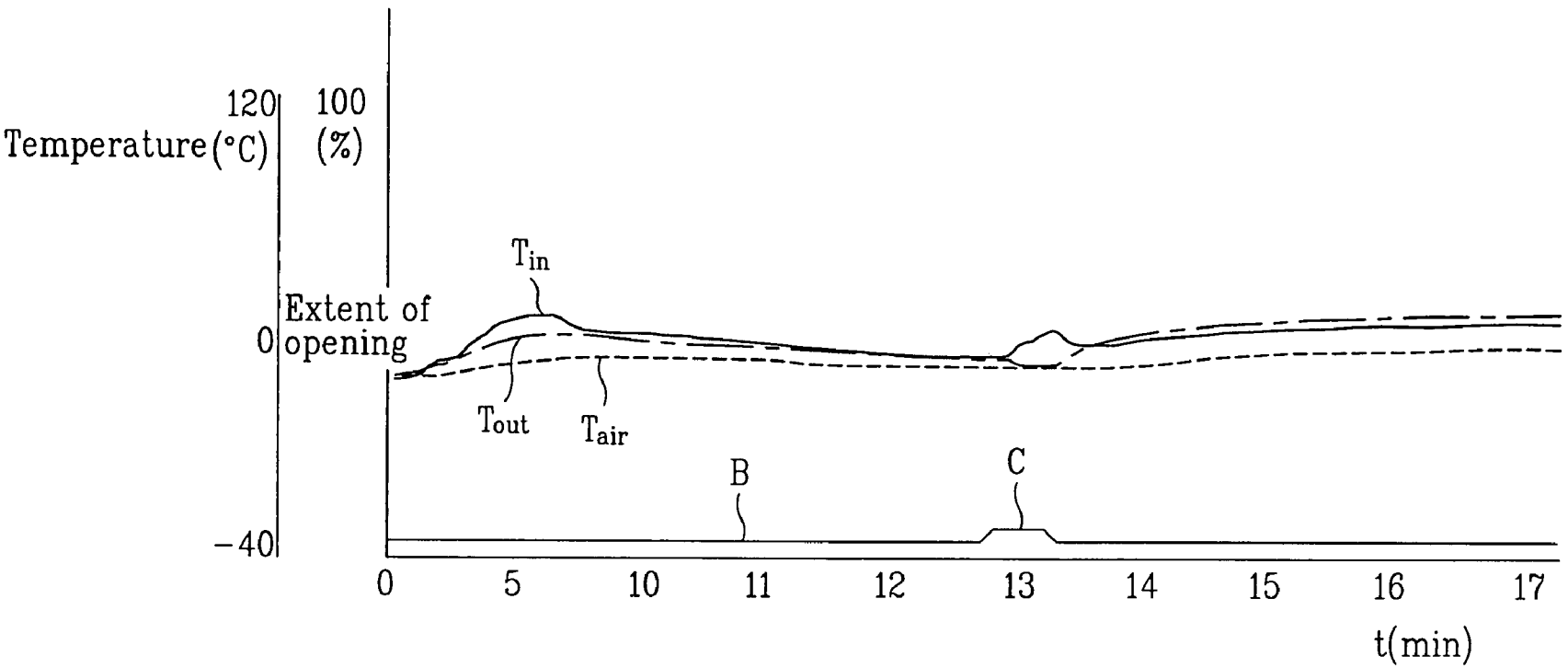
Figure 10:
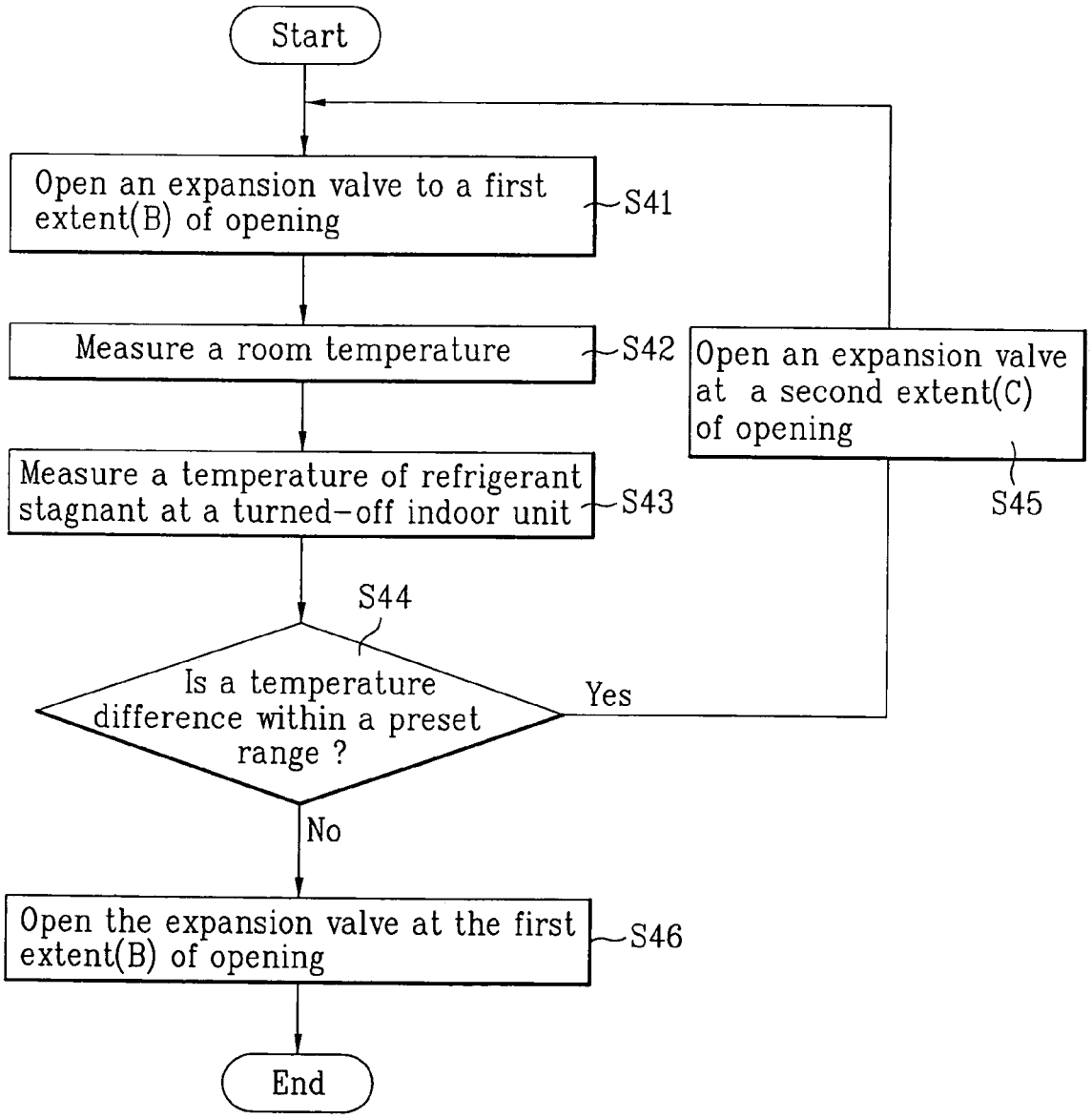

FIG. 9 illustrates a graph of a refrigerant temperature and an extent of opening of an expansion valve measured at a turned off indoor unit when a multi-type air conditioner is operated by the third preferred embodiment of the present invention; and FIG. 10 illustrates a flow chart showing the steps of a method for controlling a multi-type air conditioner in accordance with a fourth preferred embodiment of the present invention.

DETAILED DESCRIPTION OF THE PREFERRED EMBODIMENT

Figure 1:
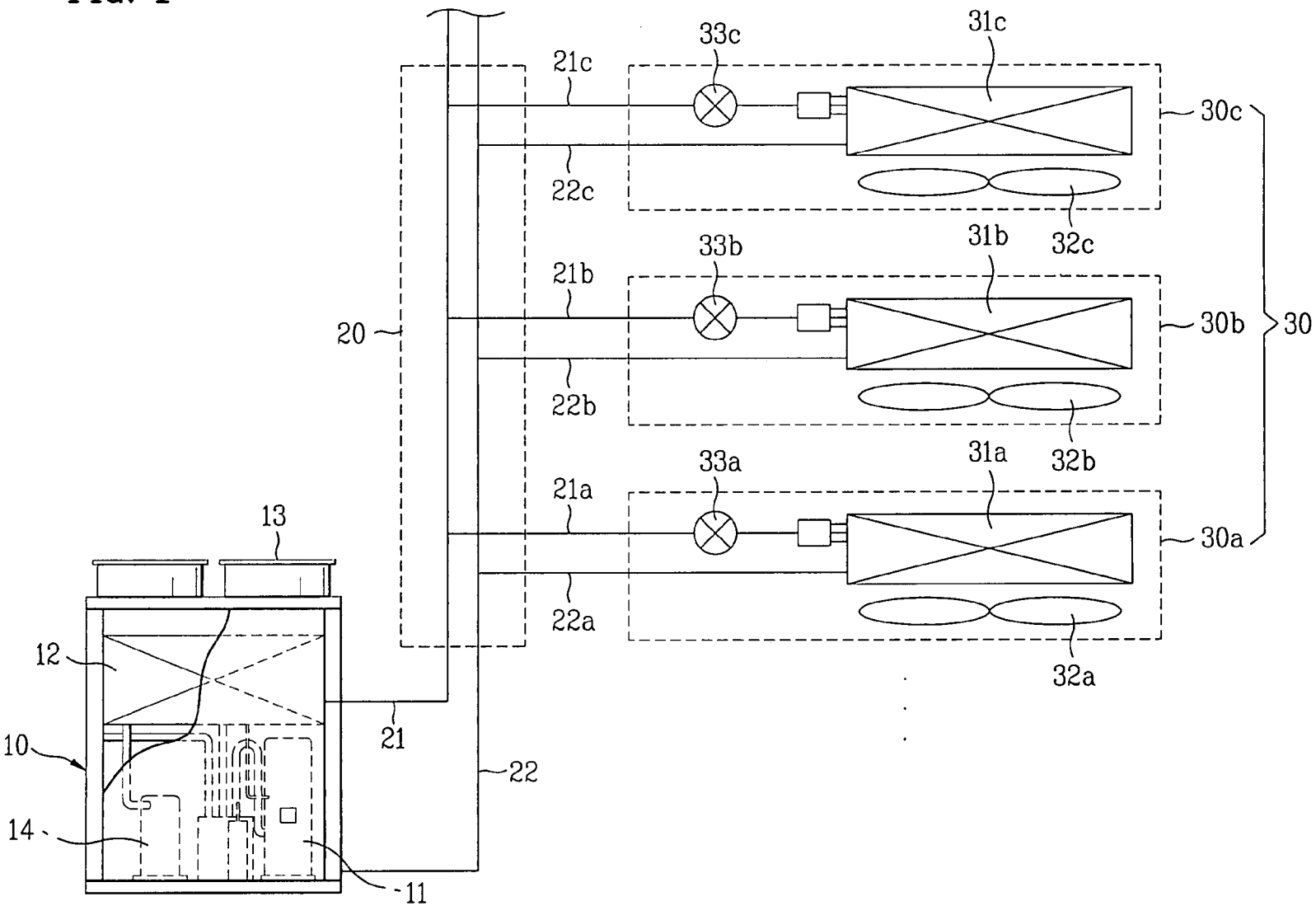
FIG. 1 illustrates a diagram of a multi-type air conditioner in accordance with a preferred embodiment of the present invention, schematically.

Reference will now be made in detail to the preferred embodiments of the present invention, examples of which are illustrated in the accompanying drawings. In describing the embodiments, same parts will be given the same names and reference symbols, and repetitive description of which will be omitted. FIG. 1 illustrates a diagram of a multi-type air conditioner in accordance with a preferred embodiment of the present invention, schematically.

Referring to FIG. 1, the multi-type air conditioner includes an outdoor unit 10, a plurality of indoor units 30, and a distributor 20 between the outdoor unit 10, and the indoor units 20.

The outdoor unit 10 includes a compressor 11, an outdoor heat exchanger 12, an outdoor fan 13, and accumulator 14, and the each of the indoor units 30*a*, 30*b*, and 30*c* includes an indoor heat exchanger 31*a*, 31*b*, or 31*c*, an indoor fan 32*a*, 32*b*, or 32*c*, and an expansion valve 33*a*, 33*b*, and 33*c*.

The distributor 20 guides the refrigerant from the outdoor unit 10 to the indoor units 30, and vice versa. For this, the distributor 20 is connected to the outdoor heat exchanger 12 with a first refrigerant pipe 21, and to the compressor 11 with a second refrigerant pipe. The distributor 20 is also connected to the indoor heat exchangers. 30*a*, 30*b*, and 30*c* with first branch pipes 21*a*, 21*b*, and 21*c* branched from the first refrigerant pipe 21, and second branch pipes 22*a*, 22*b*, and 22*c* branched from the second refrigerant pipe 22.

The first branch pipes 21*a*, 21*b*, and 21*c* has expansion valves 33*a*, 33*b*, 33*c* mounted thereon. The expansion valves 33*a*, 33*b*, and 33*c* are ordinary LEVs (Linear Expansion Valve).

Figure 2:
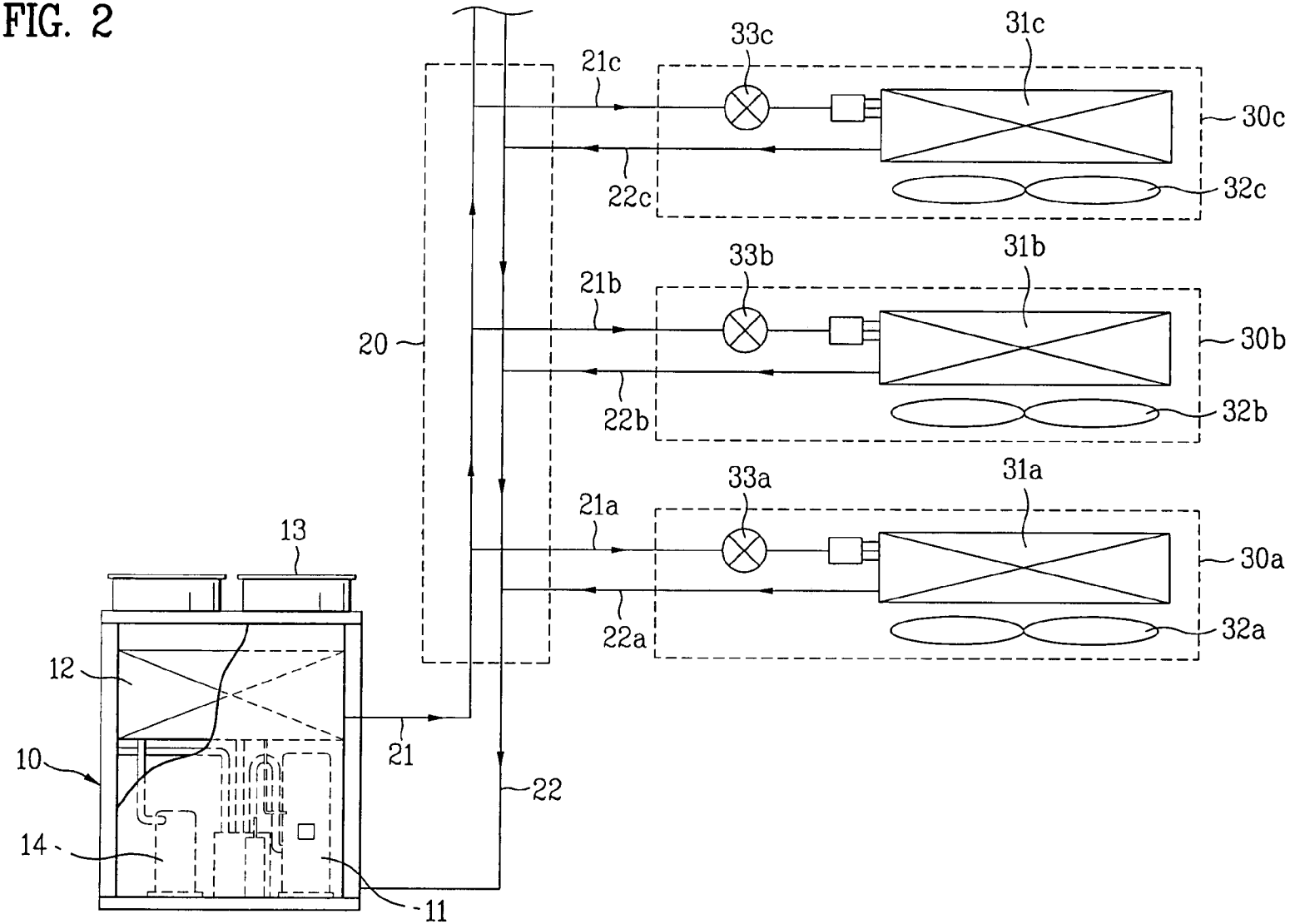
FIG. 2 illustrates a diagram of a refrigerant flow in a case the multi-type air conditioner of the present invention performs cooling.

The operation of the multi-type air conditioner will be described with reference to the attached drawings. FIG. 2 illustrates a diagram of a refrigerant flow in a case the multi-type air conditioner of the present invention performs cooling.

Referring to FIG. 2, when the multi-type air conditioner starts cooling operation, refrigerant compressed to a high temperature is introduced into the outdoor heat exchanger 12, when the refrigerant heat exchanges with outdoor air and condensed as the outdoor fan 13 rotates.

The refrigerant is then introduced into the distributor 20 following the first refrigerant pipe 21, and guided to the expansion valves 33*a*, 33*b*, and 33*c* of respective indoor units 30*a*, 30*b*, and 30*c* following the first branch pipes 21*a*, 21*b*, and 21*c*. In this instance, the refrigerant expands at respective expansion valves 33*a*, 33*b*, and 33*c*, and becomes into low temperature refrigerant.

Then, the refrigerant is introduced into the indoor heat exchangers 31*a*, 31*b*, and 31*c*, and heat exchanges with room air by the indoor fans 32*a*, 32*b*, and 32*c*, when the room air becomes low temperature air by heat exchange with the refrigerant, and discharged to the room.

Then, the refrigerant is introduced into the distributor 20 following the second branch pipes 22*a*, 22*b*, and 22*c*, and therefrom to the outdoor unit 10 following the second refrigerant pipe 22.

As above process is repeated, the low temperature air is supplied to the room, to cool down the room.

In the meantime, as described, if all the indoor units 30*a*, 30*b*, and 30*c* perform cooling, all the expansion valves 33*a*, 33*b*, and 33*c* open, to supply refrigerant to all the indoor heat exchangers 31*a*, 31*b*, and 31*c*. However, in a case only some of the indoor units 30 perform cooling, the expansion valves on turned off indoor units are closed. Therefore, in the case only some of the indoor units perform cooling, no refrigerant is supplied to the indoor heat exchangers of the turned off indoor units.

Figure 3:
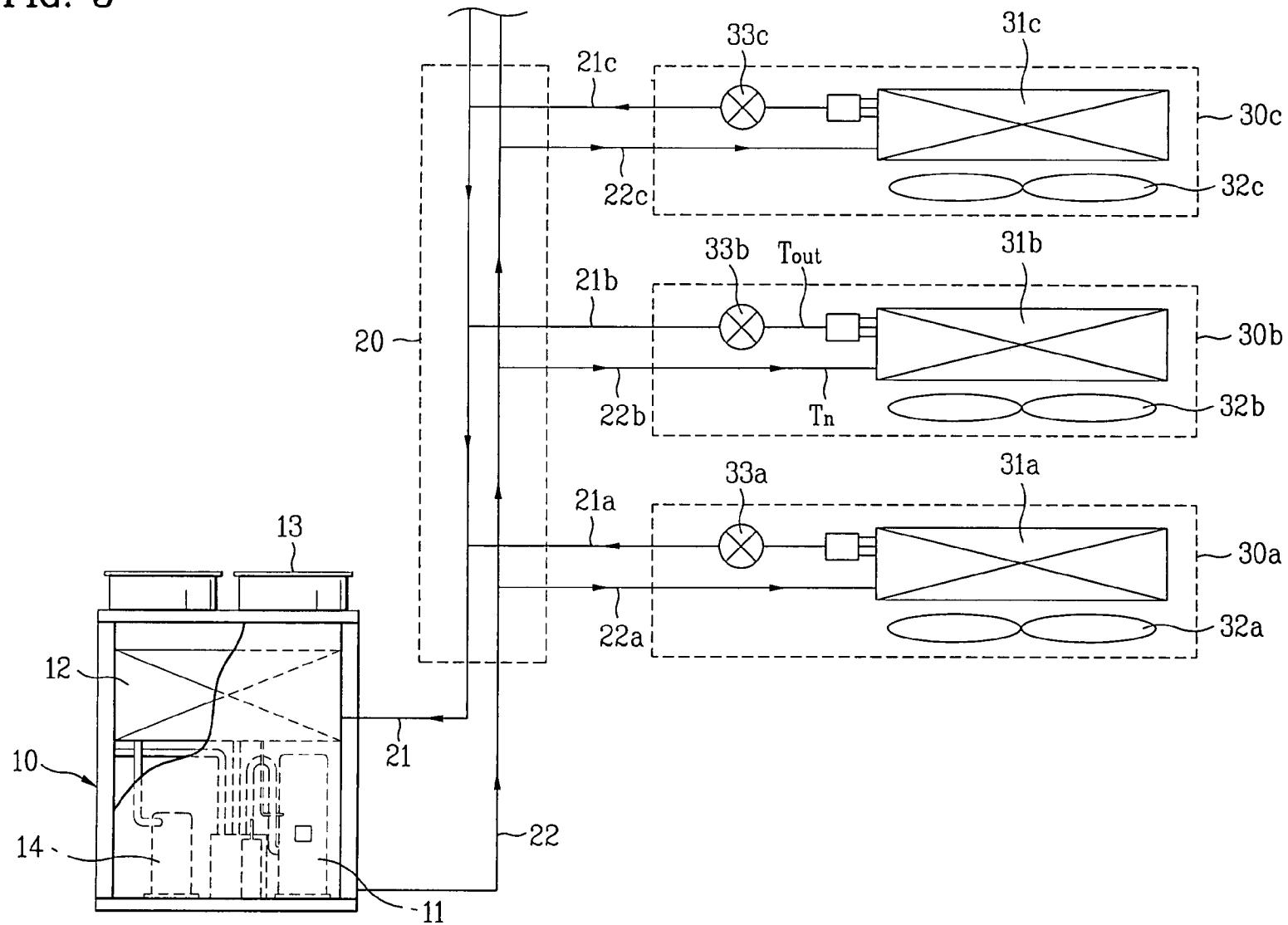
FIG. 3 illustrates a diagram of a refrigerant flow in a case only some of indoor units of a multi-type air conditioner of the present invention perform heating.

FIG. 3 illustrates a diagram of a refrigerant flow in a case only some of indoor units of a multi-type air conditioner of the present invention perform heating.

Referring to FIG. 3, when the multi-type air conditioner of the present invention starts operation, the refrigerant compressed to a high pressure at the compressor 11 is introduced into the distributor 20 through the second refrigerant pipe 22. Then, the refrigerant is introduced into respective indoor units 30*a*, 30*b*, and 30*c* through the second branches 22*a*, 22*b*, and 22*c*.

In the following description, it is assumed that, of the three indoor units 30, two indoor units 30*a*, and 30*c* heat rooms, and rest one indoor unit 30*b* is in a turned off state.

At first, the refrigerant introduced into the indoor unit 30*a*, and 30*c* heating the rooms is introduced into the indoor heat exchangers 31*a*, and 31*c*, and heat exchanges with room air. The room air heat exchanged with the refrigerant to be high temperature is discharged to the rooms by the indoor fans 32*a*, and 32*c*.

Thereafter, the refrigerant passes through, and expands at the expansion valves 33*a*, and 33*c*, and introduced into the distributor 20 following the first branch pipes 21*a*, and 21*c*. Then, the refrigerant is introduced into the outdoor heat exchanger 12 through the first refrigerant pipe 21, and heat exchanges with outdoor air, and returns to the, compressor 11 through the accumulator 14.

In the meantime, the refrigerant introduced into the turned off indoor unit 30*b* becomes stagnant at the indoor unit 30*b* as the expansion valve 33*b* is closed. In more detail, the refrigerant is stagnant at the indoor heat exchanger 31*b* and the second pipe 22*b*, and a part of the first pipe 21*b* between the expansion valve 33*b* and the indoor heat exchanger 31*b*.

According to this, the user controls the multi-type air conditioner, for removing the stagnant refrigerant from the turned off indoor unit 30*b*.

Unexplained reference symbol Tin denotes a temperature of the refrigerant introduced into the indoor heat exchanger 31*b* of the turned off indoor unit 30*b*, and Tout denotes a temperature of the refrigerant discharged from the indoor heat exchanger 31*b* of the turned off indoor unit 30*b*.

Figure 4:
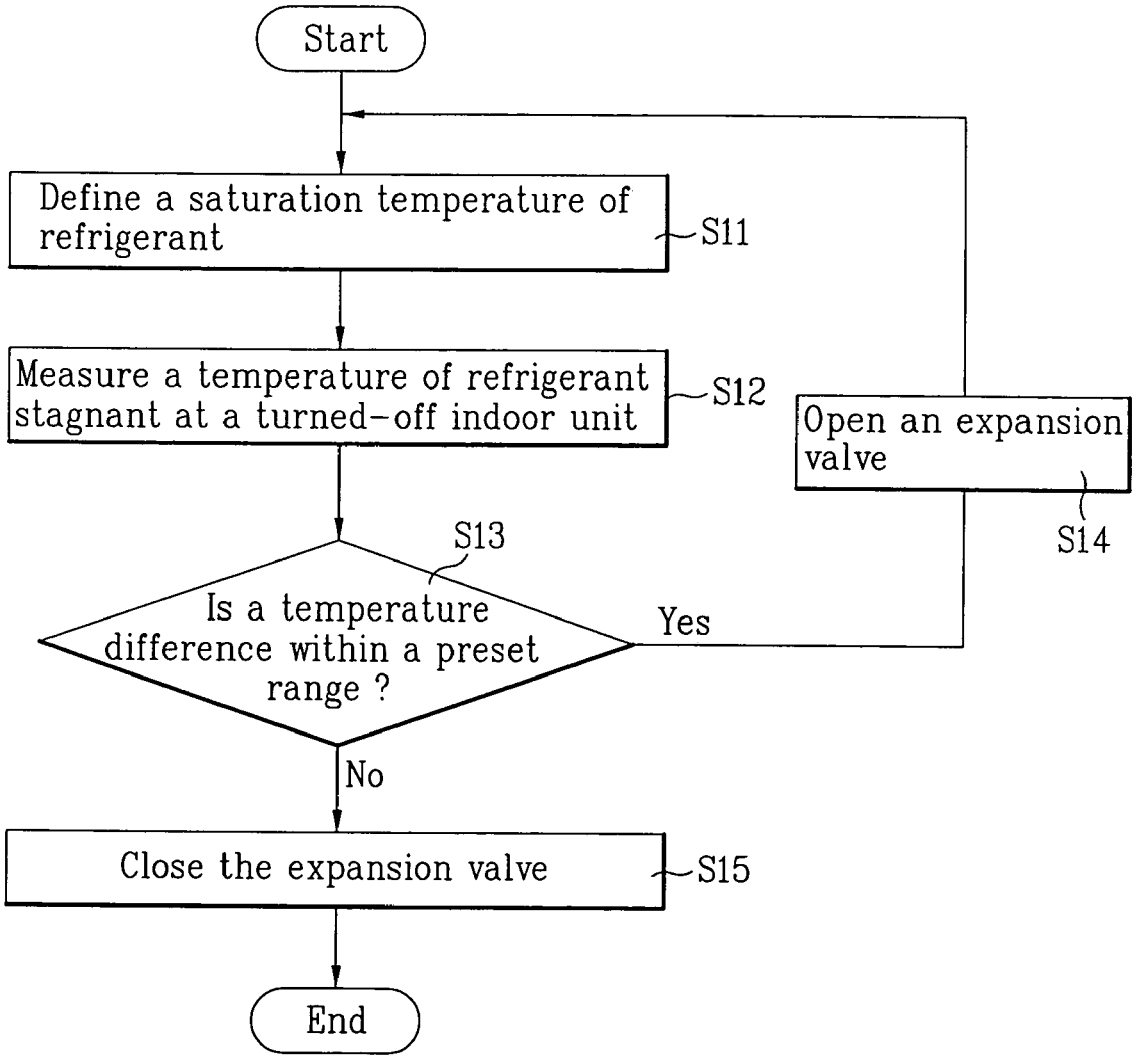
FIG. 4 illustrates a flow chart showing the steps of a method for controlling a multi-type air conditioner in accordance with a first preferred embodiment of the present invention.
Figure 5:
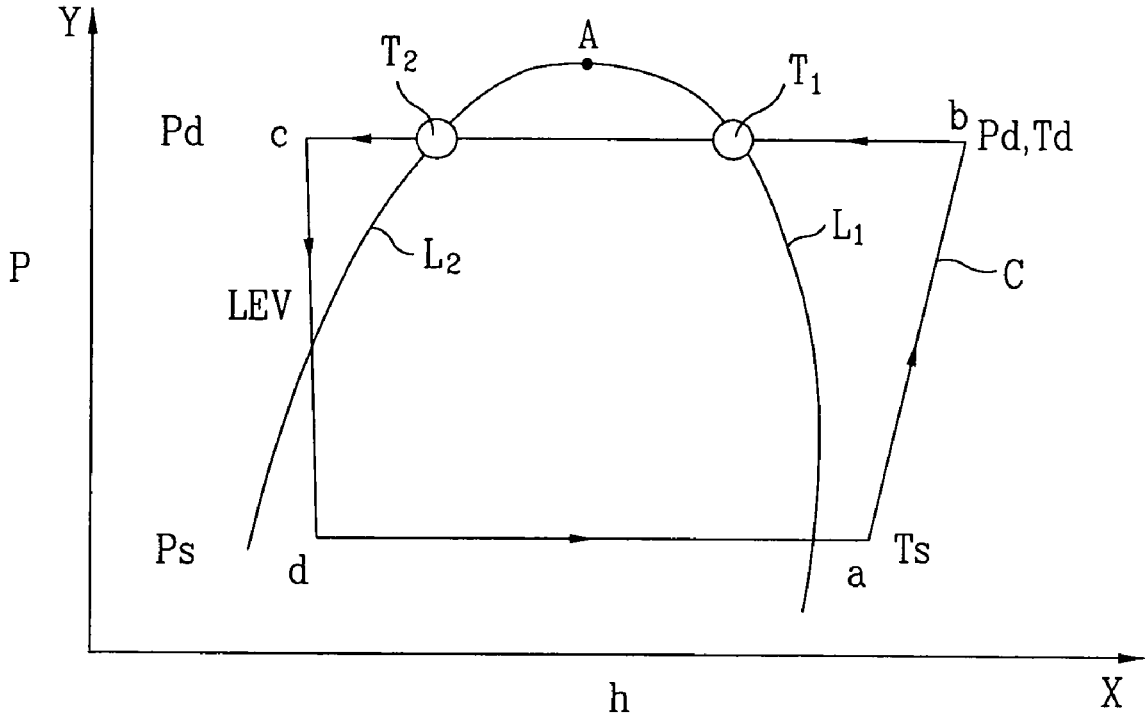
FIG. 5 illustrates a diagram of a heating cycle on a Mollier chart.

FIG. 4 illustrates a flow chart showing the steps of a method for controlling a multi-type air conditioner in accordance with a first preferred embodiment of the present invention, and FIG. 5 illustrates a diagram of a heating cycle on a Mollier chart.

Referring to FIG. 4, the method includes the following steps.

At first, when some indoor units 30*a*, and 30*c* start heating, a saturation temperature is define by using a heating cycle of the refrigerant, and the Mollier chart (S11).

Referring to FIG. 5, the Mollier chart, a pressure-enthalpy diagram, P-h diagram, with enthalpy 'h' on an X-axis and a pressure 'P' on a Y-axis, has a saturated vapor line L1, and a saturated liquid line L2. A point at which the saturated vapor line L1 and the saturated liquid line L2 meet is called as a critical point 'A'. Since the Mollier chart is known well, any further description will be omitted.

The heating cycle 'C' on the Mollier chart represents state changes of the refrigerant circulating the multi-type air conditioner. The state changes of the refrigerant moving according to the heating cycle 'C' will be described.

At first, in an a–b section (a compression section) of the heating cycle 'C', the refrigerant is compressed to a high temperature Td and high pressure Pd by the compressor 11. The Td and Pd denote a temperature and a pressure of the refrigerant discharged from the compressor 11.

That is, as the refrigerant passes the compressor 11, a temperature, and a pressure of the refrigerant rise from Ts to Td, and from Ps to Pd, respectively. In this instance, the enthalpy 'h' of the refrigerant also increases according to the increase of the temperature.

Then, the refrigerant is introduced into the indoor heat exchangers 31*a*, and 31*c* in a b–c section (a condensing section), and heat exchanged with room air, when the refrigerant loses heat, and has enthalpy reduced.

Then, the refrigerant passes through, and expands at the expansion valves 33*a*, and 33*c* in a c–d section (expansion section), to become low pressure Ps refrigerant, and is guided to the compressor 11 again through the outdoor heat exchanger 12 in a d–a section (evaporating section).

The saturation temperature is defined as a temperature T1 or T2 where the heat cycle 'C' of the refrigerant and the Mollier chart meet.

In more detail, the saturation temperature T1 or T2 is a refrigerant temperature the b–c section (condensing section) of the heating cycle 'C' and Mollier chart meet. That is, the saturation temperature T1 is a refrigerant temperature at a point where the condensing section of the heating cycle 'C' and the saturated vapor line L1 meet, and the saturation temperature T2 is a refrigerant temperature at a point where the condensing section of the heating cycle 'C' and the saturated liquid line L2 meet.

In the meantime, the b–c section of the heating cycle is horizontal P=Pd when the refrigerant is pure, like R22. The horizontal line connecting the saturated vapor line L1 and the saturated liquid line L2 is an isothermal line. That is, the saturation temperatures T1, and T2 are the same when the refrigerant is pure.

Therefore, the saturation temperature T1 and T2 can be obtained by using the Mollier chart and the heating cycle once the pressure Pd of the refrigerant discharged from the compressor 11 is measured.

However, though not shown, in a case of mixed refrigerant, such as R407C, the b–c section of the heating cycle is not horizontal, which means that T1 and T2 are not equal. Therefore, when mixed refrigerant is used, it is preferable that the saturation temperature is defined as an average or weighted average of the T1 and T2.

In this instance, the average is an arithmetic average [(T1+T2)/2] of the T1 and T2, and the weighted average is a value having a weighted value 'a' added to the average temperature [{(T1+T2)/2}+a]. Of course, it is apparent that the saturation temperature is defined As either T1 or T2 even in a case the mixed refrigerant is used.

After the saturation temperature is defined, a temperature of the refrigerant stagnant at the turned off indoor unit 30*b* is measured (S12). The refrigerant temperature is a temperature of the refrigerant in Tin/out Tout of the indoor heat exchanger 31*b* (see FIG. 3). Or, the refrigerant temperature may be an average of the Tin and Tout.

Of course, the refrigerant temperature Tin or Tout can be obtained by measuring a surface temperature of the second branch pipe 22*b* and a surface temperature of the first branch pipe 21*b* that connects the expansion valve 33*b* and the indoor heat exchanger 31*b*, approximately.

Then, it is determined if a temperature difference between the saturation temperature and the temperature of the refrigerant stagnant at the turned off indoor unit is in a temperature range preset at the control part (S13).

If the temperature difference is in the temperature range preset at the control part, the expansion valve 33*b* of the turned off indoor unit 30*b* is opened, to remove the stagnant refrigerant from the turned off indoor unit 30*b* (S14).

In this instance, it is preferable that the extent 'A' of opening of the expansion valve is 1%<A<20%. The extent of opening is determined taking a number of the turned off indoor units, or the temperature difference into account, particularly, to minimize noise caused by opening of the expansion valve 33*b*.

That is, even though a noise level of a general residential area is required to be below 65 dB in the morning, 70 dB during the day, and 55 dB during the night, it is verified from experiment that a noise level caused by opened expansion valve can be lower than above noise level, if the extent of opening is 1%<A<20%.

In the meantime, a temperature range set at the control part may be fixed, or varied with the following parameters.

At first, the temperature range may be varied with a room temperature. Or, the temperature range may be varied with an outdoor temperature. The room temperature and the outdoor temperature fix a flow rate of the refrigerant to the indoor unit for heating.

Thus, because an amount, and a time period of the refrigerant stagnant at the turned off indoor unit 30*b* can vary with the room temperature and the outdoor temperature, it is preferable that the room temperature and the outdoor temperature are taken into account in fixing the temperature range.

Of course, the temperature range may vary both with the room temperature and the outdoor temperature.

If the temperature difference is not within the temperature range preset at the control part, the expansion valve of the turned off indoor unit is closed (S15). That is, since the temperature difference being out of the preset temperature range implies that no refrigerant is stagnant at the turned off indoor unit 30*b*, the expansion valve 33*b* is closed, to prevent occurrence of the noise in advance.

In the meantime, it is preferable that above steps are repeated during some of the indoor units perform heating. Particularly, it is preferable that after the step 14 or 15 is performed, all the steps from S11 are performed in succession.

Such a feedback control enables realtime monitoring of a state of the turned off indoor unit 30*b*, and opening/closing of the expansion valve at a proper time, to minimize noise from the multi-type air conditioner caused by unnecessary opening of the expansion valve.

Figure 6:
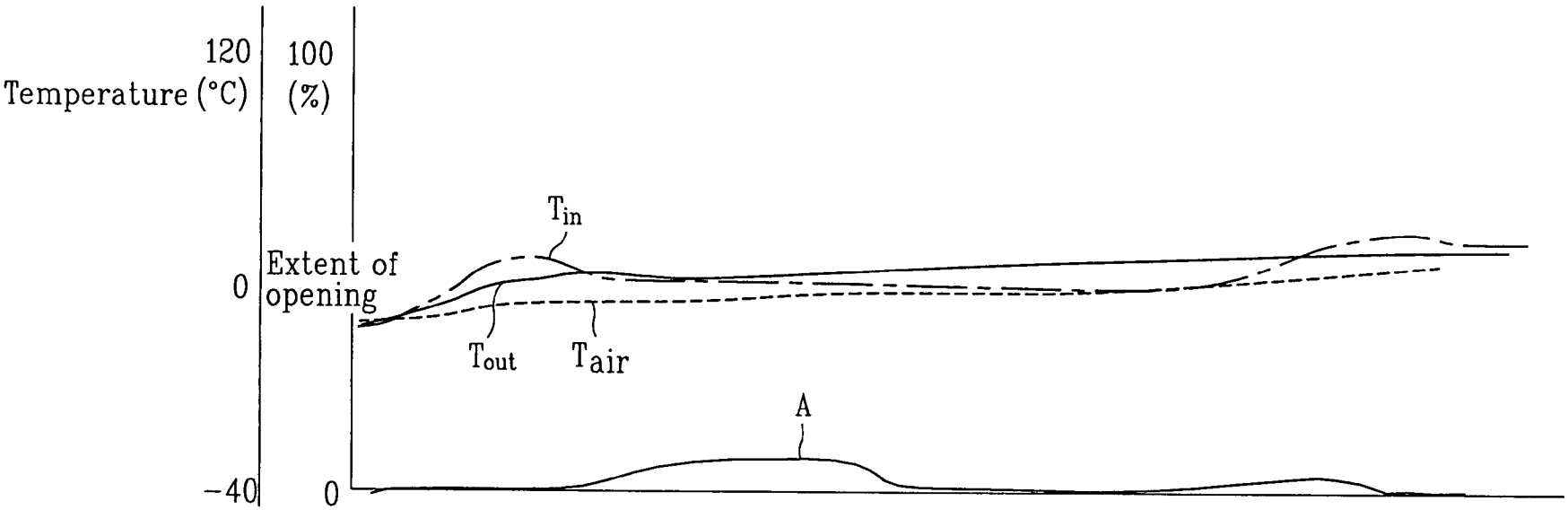
FIG. 6 illustrates a graph of a refrigerant temperature and an extent of opening of an expansion valve measured at a turned off indoor unit when a multi-type air conditioner is operated by the first preferred embodiment of the present invention.

FIG. 6 illustrates a graph of a refrigerant temperature and an extent of opening of an expansion valve measured at a turned off indoor unit when a multi-type air conditioner is operated by the first preferred embodiment of the present invention.

Referring to FIG. 6, if the refrigerant is stagnant at the turned off indoor unit 30*b*, the refrigerant temperature Tin/Tout in/out of the indoor heat exchanger 31*b* keep dropping as time goes by. That is, the refrigerant temperature comes closer to a room temperature Tair as time goes by.

In this instance, if the stagnant refrigerant is removed from the turned off indoor unit 30*b* by opening the expansion valve 33*b* to the extent of opening in accordance with the first preferred embodiment of the present invention, the temperatures Tin/Tout of the refrigerant in/out of the indoor heat exchanger 31*b* rise. This implies that, as the expansion valve 33*b* is opened, low temperature refrigerant is discharged, and new high temperature refrigerant is supplied to the indoor heat exchanger 30*b*.

Figure 7:
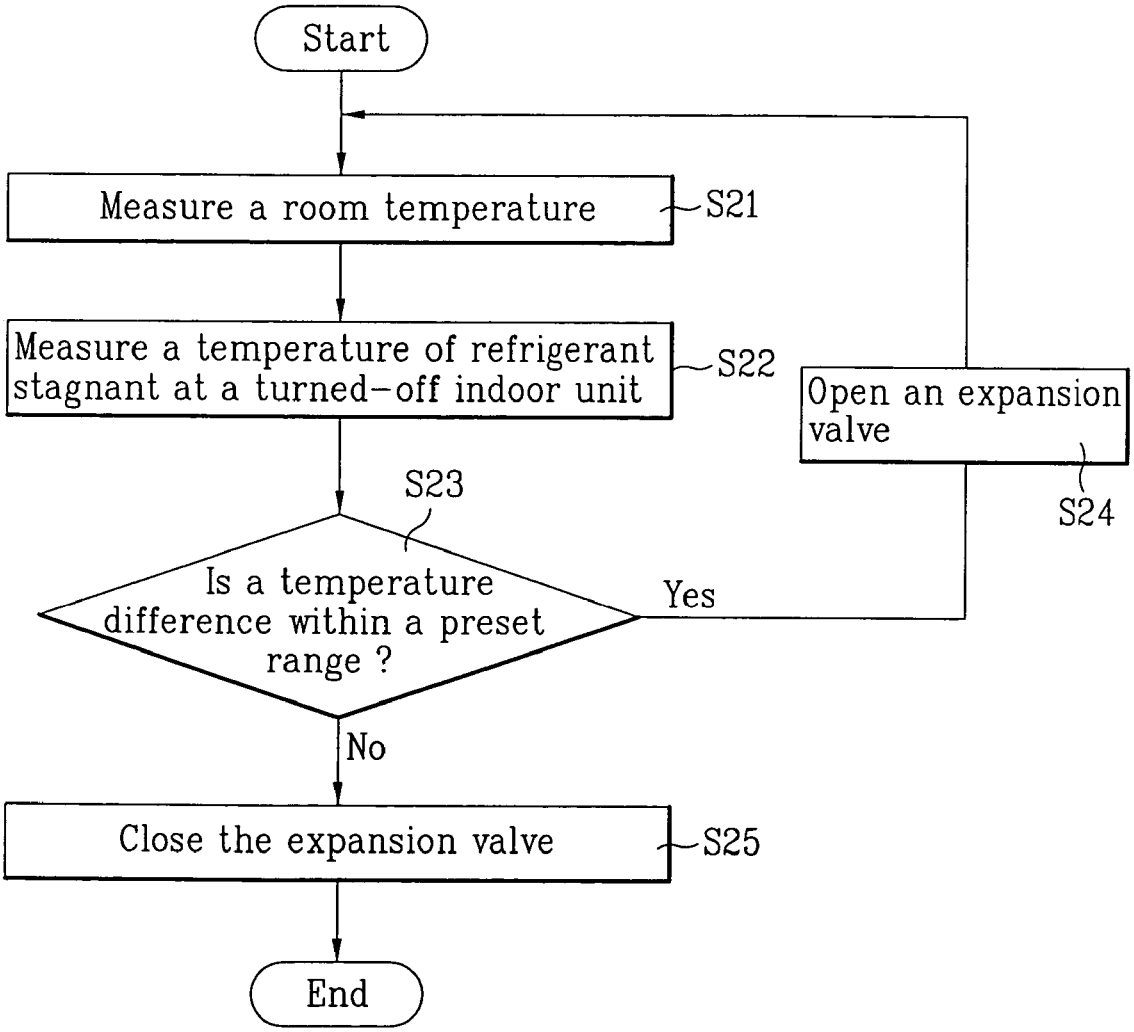
FIG. 7 illustrates a flow chart showing the steps of a method for controlling a multi-type air conditioner in accordance with a second preferred embodiment of the present invention.

FIG. 7 illustrates a flow chart showing the steps of a method for controlling a multi-type air conditioner in accordance with a second preferred embodiment of the present invention.

Referring to FIG. 7, the method for controlling a multi-type air conditioner includes the following steps.

At first, when some of the indoor units 30*a*, and 30*c* start heating operation, a room temperature is measured (S21). After measuring a temperature of the refrigerant stagnant at the turned off indoor unit 30*b* (S22), it is determined if a temperature difference of the refrigerant temperature and the room temperature is within a temperature range preset at the control part (S23).

If the temperature difference is within the temperature range preset at the control part, the expansion valve of the turned off indoor unit is opened (S24), and if the temperature difference is not within the temperature range preset at the control part, the expansion valve of the turned off indoor unit is closed (S25).

Thus, the second embodiment of the present invention is different from the first embodiment of the present invention, in that the second embodiment of the present invention determines opening of the expansion valve, not depending on the saturation temperature, but the room temperature. Particularly, the second embodiment is mostly applicable to a case the indoor units 30*a*, and 30*c* that heat the rooms are operated at a low temperature.

Figure 8:
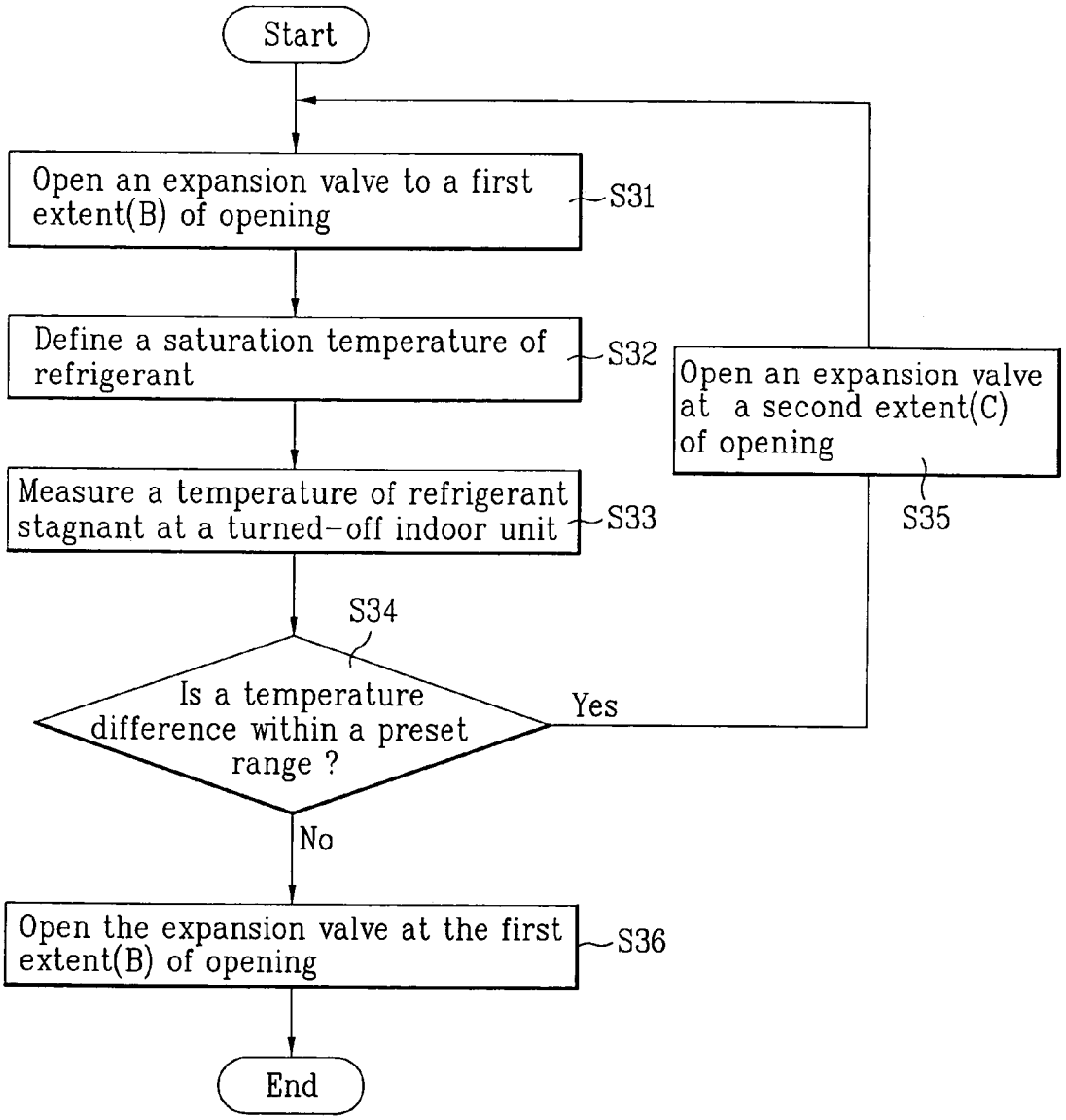
FIG. 8 illustrates a flow chart showing the steps of a method for controlling a multi-type air conditioner in accordance with a third preferred embodiment of the present invention.

FIG. 8 illustrates a flow chart showing the steps of a method for controlling a multi-type air conditioner in accordance with a third preferred embodiment of the present invention.

Referring to FIG. 8, the method for controlling a multi-type air conditioner includes the following steps.

At first, when some 30*a*, and 30*c* of the indoor units start heating operation, the expansion valve of the turned off indoor unit is opened at a first extent 'B' of opening (S31). It is preferable that the expansion valve 33*b* is opened after the multi-type air conditioner performs the heating operation for a certain time period.

It is preferable that the first extent 'B' of opening of the expansion valve is 1%<B<10%. The range of the first extent 'B' of opening is determined taking a time period required for removing the refrigerant, and a level of noise occurred into account. That is, if the first extent of opening 'B' is below 1%, to much time is required for removing the refrigerant, and if the first extent of opening 'B' is over 10%, too loud noise occurs in the heating operation.

Then, a saturation temperature of the refrigerant is defined by using the heating cycle of the refrigerant, and Mollier chart (S32). Since the saturation temperature is defined in a fashion the same with the first embodiment, no further description will be given.

In the meantime, after the saturation temperature is determined, a refrigerant temperature stagnant at the turned off indoor unit 30*b* is measured (S33). Then, it is determined if a temperature difference of the saturation temperature and the refrigerant temperature stagnant at the turned off indoor unit is within a temperature range preset at the control part (S34).

The refrigerant temperature is a temperature Tin or Tout of the refrigerant in/out of the indoor unit 31*b* (see FIG. 3). Or, the refrigerant temperature may be an average of the Tin and Tout.

Of course, the refrigerant temperatures Tin and Tout can be obtained by measuring a surface temperature of the second branch pipe 22*b* and a surface temperature of the first branch pipe 21*b* connecting the expansion valve 33*b* and the indoor heat exchanger 31*b*, approximately.

If the temperature difference is within a temperature range preset at the control part, the expansion valve 33*b* of the turned off indoor unit is opened at a second extent of opening 'C' greater than the first extent of opening 'B', and to remove the stagnant refrigerant from the turned off indoor unit (S35).

In this instance, it is preferable that the second extent of opening 'C' of the expansion valve 33*b* is 4%<C<20%. The second extent 'C' of opening is determined taking a number of the turned off indoor units, and/or the temperature difference into account, particularly, to minimize noise caused by opening of the expansion valve 33*b*.

In the meantime, the temperature range preset at the control part may be fixed, or varied with the following parameters.

At first, the temperature range may be varied with a room temperature. Or, the temperature range may be varied with an outdoor temperature. The room temperature and the outdoor temperature fix a flow rate of the refrigerant to the indoor unit for heating.

Thus, because an amount, and a time period of the refrigerant stagnant at the turned off indoor unit 30*b* can vary with the room temperature and the outdoor temperature, it is preferable that the room temperature and the outdoor temperature are taken into account in fixing the temperature range.

Of course, it is apparent that the temperature range may vary both with the room temperature and the outdoor temperature.

If the temperature difference is not within the temperature range preset at the control part, the expansion valve of the turned off indoor unit is opened at the first extent "B" of opening (S36).

In the meantime, it is preferable that a feedback control is performed during some of the indoor units perform heating, in which, after the S35 step or the S36 step is performed, steps starting from the S32 step are performed in succession again.

FIG. 9 illustrates a graph of a refrigerant temperature and an extent of opening of an expansion valve measured at a turned off indoor unit when a multi-type air conditioner is operated by the third preferred embodiment of the present invention.

Referring to FIG. 9, if the refrigerant is stagnant at the turned off indoor unit 30*b*, the refrigerant temperature Tin/Tout in/out of the indoor heat exchanger 31*b* keep dropping as time goes by. That is, the refrigerant temperature comes closer to a room temperature Tair as time goes by.

In this instance, if the stagnant refrigerant is removed from the turned off indoor unit 30*b* by opening the expansion valve 33*b* to the second extent 'C' of opening, the temperatures Tin/Tout of the refrigerant in/out of the indoor heat exchanger 31*b* rise. This implies that, as the expansion valve 33*b* is opened to the second extent 'C' of opening, low temperature refrigerant is discharged, and new high temperature refrigerant is supplied to the indoor heat exchanger 30*b*.

However, since the expansion valve 33*b* is in an opened state from the starting at the first extent 'B' of opening in the third embodiment of the present invention, the refrigerant is not liable to be stagnant at the turned off indoor unit 30*b*, and the refrigerant temperature also drops moderately compared to the first, or second embodiment.

Accordingly, the third embodiment of the present invention can reduce noise as frequency of opening of the expansion valve 33*b* is reduced for the same time period.

FIG. 10 illustrates a flow chart showing the steps of a method for controlling a multi-type air conditioner in accordance with a fourth preferred embodiment of the present invention.

Referring to FIG. 10, the method for controlling a multi-type air conditioner includes the following steps.

When some indoor units 30*a*, and 03*c* start heating operation, the expansion valve of the turned off indoor unit is opened at a first extent 'B' of opening (S41). It is preferable that the first extent 'B' of opening of the expansion valve is 1%<B<10%.

Then, a room temperature is measured (S42). Then, a temperature of the refrigerant stagnant at the turned off indoor unit 30*b* is measured (S43), and it is determined if a temperature difference of the refrigerant temperature and the room temperature is within a temperature range preset at the control part (S44).

If the temperature difference is within the temperature range preset at the control part, the expansion valve 33*b* of the turned off indoor unit is opened to a second extent 'C' of opening greater than the first extent of opening 'B', to remove the stagnant refrigerant from the turned off indoor unit (S45).

If the temperature difference is not within the preset temperature range, the expansion valve 33*b* of the turned off indoor unit is opened at the first extent 'B' of opening (S46).

Thus, the fourth embodiment of the present invention is different from the third embodiment in that the fourth embodiment of the present invention determines opening of the expansion valve 33*b*, not depending on the saturation temperature, but depending on the room temperature. Particularly, the fourth embodiment is mostly used when the indoor units 30*a*, and 30*c* that heat the rooms are operated at a low temperature.

As has been described, the method for controlling a multi-type air conditioner of the present invention has the following advantages.

First, by opening the expansion valve within an appropriate range, an amount of refrigerant stagnant at the turned off indoor unit is minimized, and noise caused by opening of the expansion valve is reduced.

Second, the realtime measurement of the saturation temperature of the refrigerant and the temperature of the refrigerant stagnant at the turned off indoor unit, and opening of the expansion valve according to the measurement permits an operation for removing the stagnant refrigerant from the indoor unit at an appropriate time.

Third, the minimizing of an amount of refrigerant stagnant at the turned off indoor unit by opening the expansion valve at the first extent of opening permits to increase an opening period of the expansion valve, to reduce noise caused by the opening of the expansion valve.

Fourth, the minimizing of refrigerant stagnant at the turned off indoor unit permits to increase an amount of refrigerant circulating through the heating cycle. According to this, the unnecessary temperature rise, and drop of a discharge pressure of the refrigerant discharged from the compressor caused by reduction of circulating refrigerant amount can be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for controlling a multi-type air conditioner having a plurality of indoor units each with an expansion valve, an indoor heat exchanger, and an indoor fan, the multi-type air conditioner being operable in a condition wherein some of the indoor units heat rooms, and a remainder of the indoor units are turned off, the method comprising:

defining a saturation temperature of refrigerant by using a heating cycle of the refrigerant, and Mollier chart;

measuring a temperature of stagnant refrigerant at the turned off indoor units;

determining if a temperature difference between the refrigerant temperature and the saturation temperature is within a preset temperature range;

opening the expansion valves of the turned off indoor units, when the temperature difference is within the preset temperature range; and closing the expansion valve of the turned off indoor units, when the temperature difference is not within the preset temperature range.

2. The method as claimed in claim 1, wherein the opening comprises opening the expansion valve within an opening range of 1% and 20%.

3. The method as claimed in claim 1, further comprising again performing the defining, the measuring, and the determining after performing the opening.

4. The method as claimed in claim 1, further comprising again performing the defining, the measuring, the determining, and the opening after performing the closing.

5. The method as claimed in claim 1, wherein the refrigerant is pure refrigerant, and the saturation temperature is a temperature of an intersection of a condensing section of the heating cycle and the Mollier chart.

6. The method as claimed in claim 1, wherein the refrigerant is mixed refrigerant, and the saturation temperature is defined as an average of the temperatures of intersections of a condensing section of the heating cycle and the Mollier chart.

7. The method as claimed in claim 1, wherein the refrigerant is mixed refrigerant, and the saturation temperature is defined as a weighted average of the temperatures intersections of a condensing section of the heating cycle and the Mollier chart.

8. The method as claimed in claim 1, wherein the refrigerant temperature is a temperature of the refrigerant introduced into the indoor heat exchanger.

9. The method as claimed in claim 1, wherein the refrigerant temperature is a temperature of the refrigerant discharged from the indoor heat exchanger.

10. The method as claimed in claim 1, wherein the refrigerant temperature is an average of a temperature of the refrigerant introduced into the indoor heat exchanger, and a temperature of the refrigerant discharged from the indoor heat exchanger.

11. The method as claimed in claim 1, wherein the preset temperature range varies with a room temperature.

12. The method as claimed in claim 1, wherein the preset temperature range varies with an outdoor temperature.

13. The method as claimed in claim 1, wherein the preset temperature range varies with a room temperature and with an outdoor temperature.

14. A method for controlling a multi-type air conditioner having a plurality of indoor units each with an expansion valve, an indoor heat exchanger, and an indoor fan, the multi-type air conditioner being operable in a condition wherein some of the indoor units heat rooms, and a remainder of the indoor units are turned off, the method comprising:

defining a room temperature;

measuring a temperature of stagnant refrigerant at the turned off indoor units;

determining if a difference between the refrigerant temperature and the room temperature is within a preset temperature range;

opening the expansion valves of the turned off indoor units, when the temperature difference is within the preset temperature range; and closing the expansion valve of the turned off indoor units, when the temperature difference is not within the preset temperature range.

15. A method for controlling a multi-type air conditioner having a plurality of indoor units each with an expansion valve, an indoor heat exchanger, and an indoor fan, the multi-type air conditioner being operable in a condition wherein some of the indoor units, heat rooms, and a remainder of the indoor units are turned off, the method comprising:

opening the expansion valves of the turned off indoor units to a first opening extent;

defining a saturation temperature of refrigerant by using a heating cycle of the refrigerant, and Mollier chart;

measuring a temperature of stagnant refrigerant at the turned off indoor units;

determining if a difference between the refrigerant temperature and the saturation temperature is within a preset temperature range;

opening the expansion valves of the turned off indoor units to a second opening extent, greater than the first opening extent, when the temperature difference is within the preset temperature range; and opening the expansion valves of the turned off indoor units to the first opening extent, when the temperature difference is not within the preset temperature range.

16. The method as claimed in claim 15, wherein the first opening extent of the expansion valve is in the range of between 1% and 10%.

17. The method as claimed in claim 16, wherein the second opening extent of the expansion valve is in the range of between 4% and 20%.

18. The method as claimed in claim 15, further comprising again performing the defining, the measuring, the determining, and the opening to the first extent after performing the opening to the second extent.

19. The method as claimed in claim 15, further comprising again performing the defining, the measuring, the determining, the opening to the first extent and the opening to the second extent after performing the opening to the second extent.

20. The method as claimed in claim 15, wherein the refrigerant is pure refrigerant, and the saturation temperature is a temperature of an intersection of a condensing section of the heating cycle and the Mollier chart.

21. The method as claimed in claim 15, wherein the refrigerant is mixed refrigerant, and the saturation temperature is an average of the temperatures of intersections of a condensing section of the heating cycle and the Mollier chart.

22. The method as claimed in claim 15, wherein the refrigerant is mixed refrigerant, and the saturation temperature is a weighted average of the temperatures of intersections of a condensing section of the heating cycle and the Mollier chart.

23. The method as claimed in claim 15, wherein the refrigerant temperature is a temperature of the refrigerant introduced into the indoor heat exchanger.

24. The method as claimed in claim 15, wherein the refrigerant temperature is a temperature of the refrigerant discharged from the indoor heat exchanger.

25. The method as claimed in claim 15, wherein the refrigerant temperature is an average of a temperature of the refrigerant introduced into the indoor heat exchanger, and a temperature of the refrigerant discharged from the indoor heat exchanger.

26. The method as claimed in claim 15, wherein the preset temperature range varies with a room temperature.

27. The method as claimed in claim 15, wherein the preset temperature range varies with an outdoor temperature.

28. The method as claimed in claim 15, wherein the preset temperature range varies with a room temperature and with an outdoor temperature.

29. A method for controlling a multi-type air conditioner having a plurality of indoor units each with an expansion valve, an indoor heat exchanger, and an indoor fan, the multi-type air conditioner being operable in a condition wherein some of the indoor units heat rooms, and a remainder of the indoor units are turned off, the method comprising:

opening the expansion valves of the turned off indoor units to a first opening extent;

measuring a room temperature;

measuring a temperature of stagnant refrigerant at the turned off indoor units;

determining if a difference between the stagnant refrigerant temperature and the room temperature is within a preset temperature range;

opening the expansion valves of the turned off indoor units to a second opening extent, greater than the first opening extent, when the temperature difference is within the preset temperature range; and opening the expansion valves of the turned off indoor units to the first opening extent, when the temperature difference is not within the preset temperature range.

* * * * *